United States Patent [19]

Rowe

[11] Patent Number: 4,708,520

[45] Date of Patent: Nov. 24, 1987

[54] CONCRETE FINISHING MACHINE WITH ADJUSTABLE AUGER UNIT

[75] Inventor: Murray A. Rowe, Canton, S. Dak.

[73] Assignee: CMI Corporation, Oklahoma City, Okla.

[21] Appl. No.: 9,355

[22] Filed: Jan. 30, 1987

[51] Int. Cl.[4] ..... E01C 19/23

[52] U.S. Cl. ..... 404/103; 404/115; 404/120

[58] Field of Search ..... 404/101-103, 404/106, 113-115, 118-120

[56] References Cited

U.S. PATENT DOCUMENTS

| | | | |
|---|---|---|---|
| 3,528,348 | 9/1970 | Rowe et al. | 404/120 |
| 3,738,763 | 6/1973 | Glesmann | 404/119 |
| 4,068,970 | 1/1978 | Rowe | 404/120 |
| 4,320,987 | 3/1982 | Rowe et al. | 404/115 |
| 4,466,757 | 8/1984 | allen | 404/119 X |
| 4,572,704 | 2/1986 | Allen | 404/119 X |

OTHER PUBLICATIONS

"Bid-Well Concrete Finishers", Feb., 1984.

*Primary Examiner*—Stephen J. Novosad
*Assistant Examiner*—Letchford, John F.
*Attorney, Agent, or Firm*—Emrich & Dithmar

[57] ABSTRACT

A concrete finishing machine includes two finishing cylinders with two augers mounted in line with the two cylinders, forward ends of the augers being suspended by a frame which is pivotally attached to the cylinder support frame and rearward ends of the augers being connected through flexible couplings to the output ends of the cylinder shafts, allowing adjustment in the angle of inclination of the auger support frame, pivoting the two augers relative to the plane of the cylinder shafts.

12 Claims, 5 Drawing Figures

CONCRETE FINISHING MACHINE WITH ADJUSTABLE AUGER UNIT

BACKGROUND OF THE INVENTION

This invention relates to concrete finishing machines and more particularly to a concrete finishing machine including an adjustable auger unit.

In many concrete finishing machines, it is common practice to employ one or more augers mounted forward of the finishing unit which may comprise a screed mechanism or finishing cylinders. The augers are arranged and formed such that rotation of the augers during operation of the machine causes the augers to move concrete toward the space between the augers as well as longitudinally outwardly from the augers away from the finishing unit. In this manner, excess concrete is plowed forward on every pass. The augers on the concrete finishing machine are adjusted to leave the proper amount of concrete at the leading edge of the finishing unit to obtain the best finish.

In one known concrete finishing machine disclosed in U.S. Pat. No. 4,068,970 in which the finishing unit includes a screed mechanism, the augers comprise an assembly separate from the screed mechanism and driven through a separate motor. This arrangement enables the auger unit to move independently of the screed mechanism and permits independent adjustment of the auger relative to the screed mechanism, but adds the complexity and cost of the additional drive for the auger unit.

In other known concrete finishing machines of the type employing finishing rollers, a pair of horizontally extending augers are connected directly and non-adjustably to the output shafts of a pair of finishing rollers and driven thereby. In order to leave enough concrete for finishing with this machine it is necessary to raise the front edge of the augers which raises the rollers and takes them off grade. This also has the effect of lowering the rear end of the rollers which leaves a mark in the concrete. Both results are unsatisfactory. Additionally, adjustment to establish the desired grade, requires raising the rearward edge of the finishing cylinders vertically upward relative to the leading edge of the cylinders. This adjustment causes the forward end of the augers to be pivoted downward so that less concrete than desired is pulled from the forward edge of the cylinders to the forward end of the finishing carriage. This requires adjustment of the height of the auger unit which disturbs the previously set finishing grade height and disturbs the correct concrete grade.

Thus, it would be desirable to have a concrete finishing machine including an auger unit having one or more augers driven directly by one or more finishing rolls, and wherein the angle of inclination of the augers relative to the axis of the finishing rollers is adjustable independently of grade adjustments made to the finishing rolls.

SUMMARY OF THE INVENTION

The present invention provides a concrete finishing machine of the type embodying an elongated main frame having first and second ends, height adjusting means for adjusting the vertical height of the main frame, means for moving the main frame longitudinally along a roadway or the like being surfaced, a surfacing unit for finishing a concrete surface, and means for moving the surfacing unit longitudinally back and forth along the main frame between its first and second ends. In accordance with the invention, the surfacing unit comprises a carriage, finishing cylinder means, means rotatably mounting the cylinder means in the frame and drive means coupled to the cylinder means for rotating the cylinder means. The surfacing unit further comprises first and second augers and auger support means including an auger support frame extending generally axially of the cylinder means. The auger support frame has a forward end and a rearward end, and a mounting means pivotally mounts the auger support frame at its rearward end to the carriage. A suspension means on the auger support frame extends downwardly therefrom near the forward end thereof supporting forward ends of the first and second augers. A flexible coupling means couples rearward ends of the first and second augers to the cylinder means whereby the augers are connected to and rotated by the drive means as the cylinder means is rotated. An adjustable support means connected between the carriage and the auger support frame is adjustable to vary the angle of inclination of the auger support frame and the augers supported thereby relative to the longitudinal axis of the cylinder means.

The height adjusting means includes means adjusted to position the ends of the frame vertically to thereby locate the forward and rearward ends of the finishing cylinder means at a vertical height corresponding to the correct final grade for the concrete surface. The adjustable support means includes means adjusted to position the auger support frame relative to the roadway being surfaced for maintaining at the leading edge of the finishing cylinder sufficient concrete to permit optimum finishing of the concrete surface.

The invention consists of certain novel features and structural details hereinafter fully described, illustrated in the accompanying drawings, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF A PREFERRED EMBODIMENT

Figure 1:
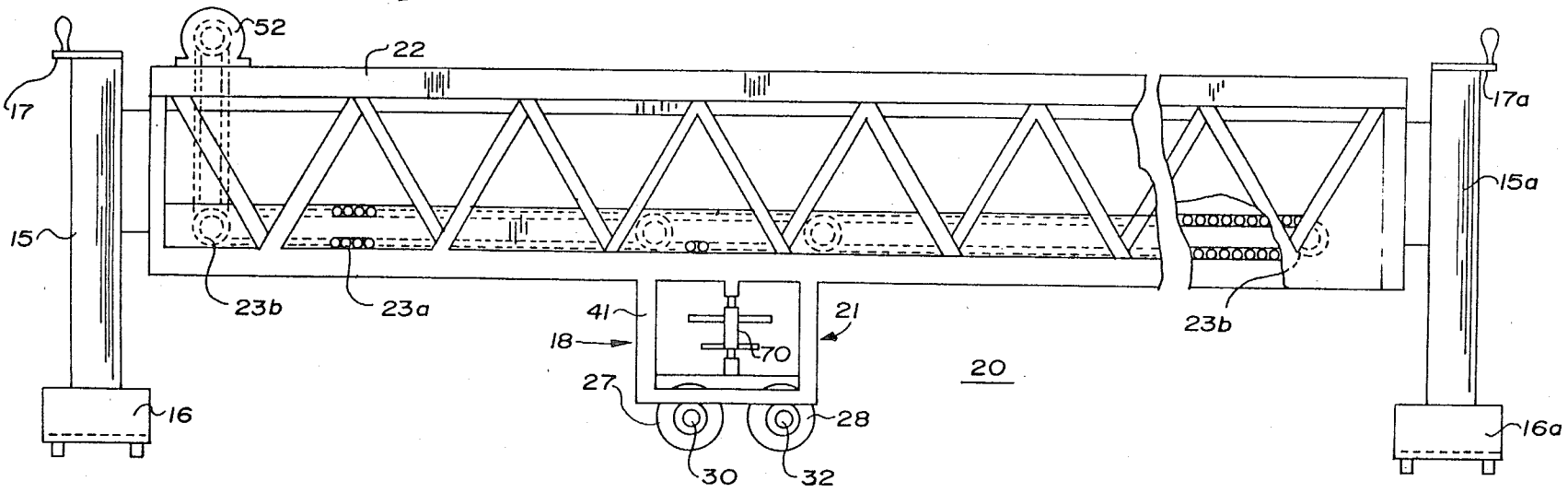
FIG. 1 is a front elevation view of a concrete finishing machine including an adjustable auger unit provided in accordance with the present invention.
Figure 2:
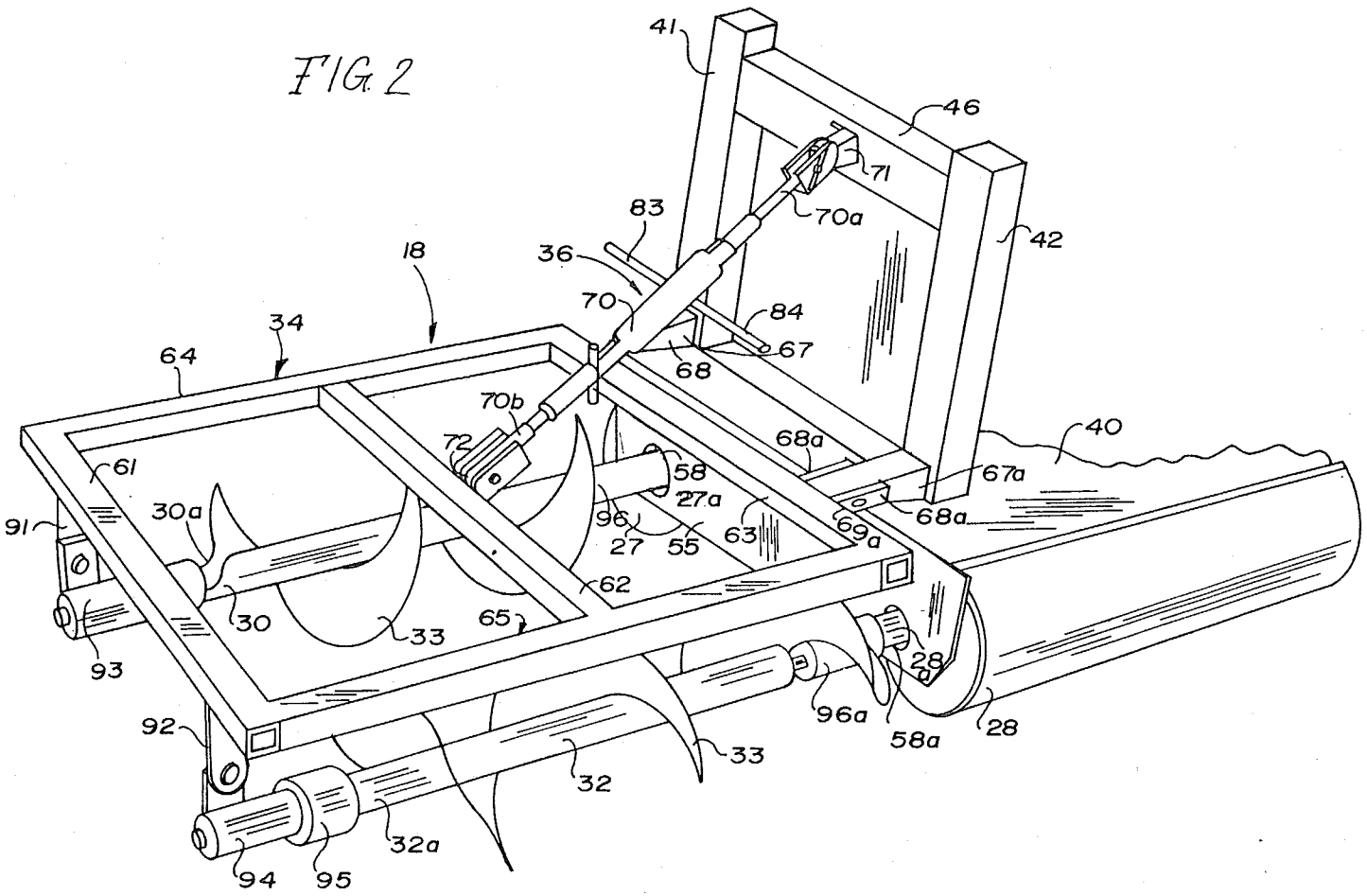
FIG. 2 is an enlarged fragmentary perspective view of a portion of the surfacing unit of the apparatus shown in FIG. 1, illustrating the adjustable auger unit.

Referring to FIGS. 1 and 2, the adjustable auger unit 18 provided by the present invention, is described with a reference to application in a concrete finishing machine 20 which is of the type disclosed in U.S. Pat. No. 3,738,763, Letters issued to Herbert C. Glesmann on June 12, 1973. However, as will be appreciated by those skilled in the art, this is merely by way of illustration and not by way of limitation, and the adjustable auger unit 18 may be used on other suitable types of concrete finishing machines, or as a separate machine, without departing from the purview of the broader aspects of the present invention.

The concrete finishing machine 20 includes a generally rectangular elongated trusswork or frame 22 which is supported at its four corners by four carriages, such as carriages 15 and 15*a* shown in FIG. 1, each including a bogie or truck 16, 16*a* for transporting the machine 20 longitudinally along a roadway or the like being finished. Each carriage also includes a handjack 17, 17*a* permitting vertical adjustment of the machine relative to the roadway. The frame 22 supports a surfacing unit 21, which is movable longitudinally of the frame 22 by a chain drive system 23 including an endless chain 23*a* trained over sprocket wheels 23*b* driven by a motor 52. The concrete finishing machine may include a control console (not shown) is mounted on the frame 22 from which an operator may control operation of the machine 20. The frame 22 extends transversely of a roadway or the like being finished, and the machine 20 is adapted to be moved lengthwise of the roadway in a direction transverse to the length of the frame 22 in a manner known in the art as described in the referenced U.S. Pat. No. 3,738,763.

Figures 3, 4, 5:
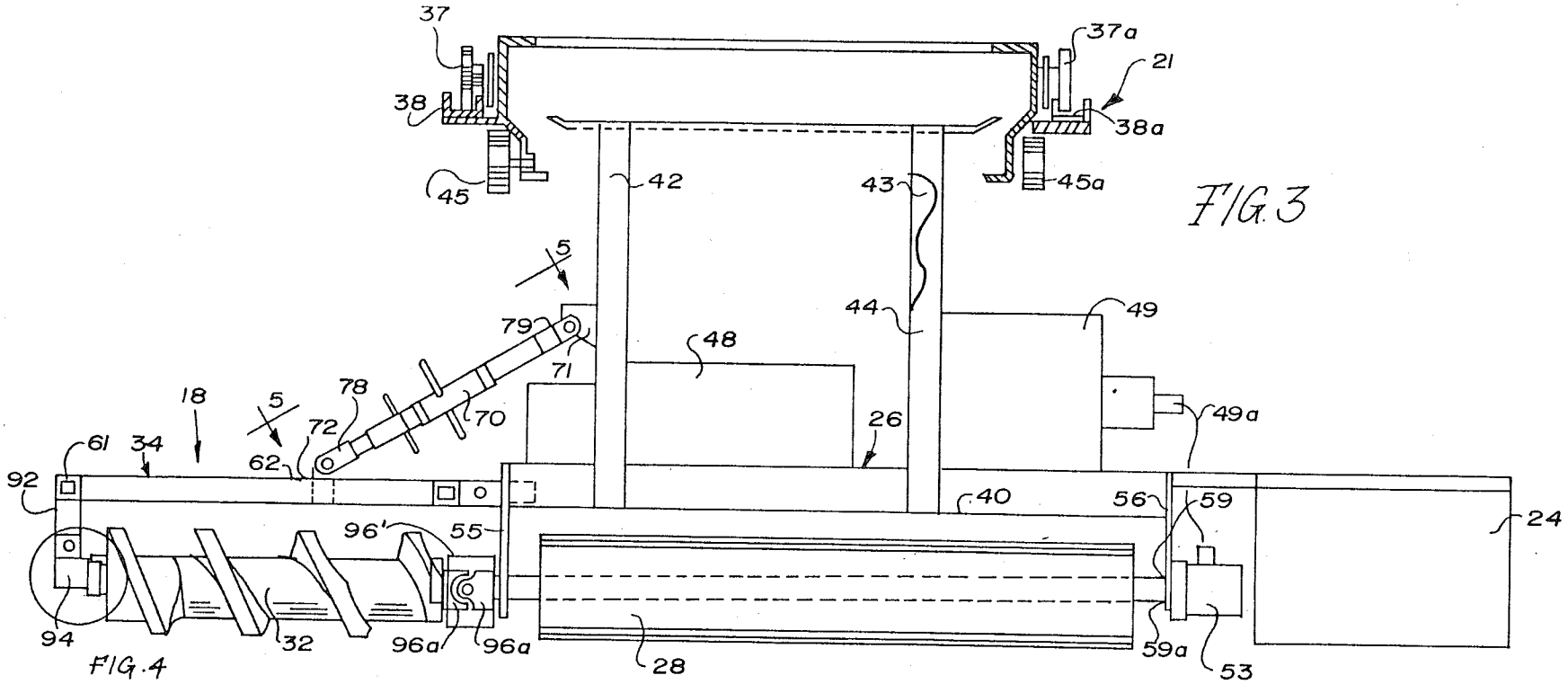
FIG. 3 is a side elevation view, partially in section, of the concrete finishing machine, illustrating the surfacing unit.
FIG. 4 is an enlarged detailed view of the auger mounting contained within the circle in FIG. 3.
FIG. 5 is a view taken along the line 5—5 in FIG. 3 illustrating an adjustment mechanism for the auger mounting.

The surfacing unit 21 is mounted on and suspended from the frame 22, FIGS. 2 and 3. The surfacing unit 21 includes the adjustable auger unit 18, a finishing pan 24, and finishing roller unit 25. An elongated carriage 26 which supports the finishing roller unit 25 includes substantially horizontally extending, elongated concrete-smoothing members in the form of cylinders 27 and 28, journaled in and suspended from the lower portion of the carriage 26 and movable therewith.

The adjustable auger unit 18 includes two elongated conveyor screws or augers 30 and 32, an auger support frame 34 and an adjustment mechanism 36. The augers 30 and 32 are disposed forwardly of the front end of respective cylinders 27 and 28 and aligned axially thereof, in substantially horizontal, uniplanar, spaced relation to each other as shown in FIGS. 2 and 3. The helical blades 33 of the augers 30 and 32 are formed with opposite pitch and rotated in opposite direction such that during operation of the machine 20, the blades 33 are rotated in such direction that concrete engaged thereby tends to move toward the space between the augers 30 and 32 as well as longitudinally outwardly along the augers 30 and 32 away from the cylinders 27 and 28, as is known in the art. An example of a concrete finishing machine with dual augers is disclosed in Rowe et al al U.S. Pat. No. 3,528,348, which issued Sept. 15, 1970. Engagement of the conveyor augers 30 and 32 with concrete material during movement of the concrete-smoothing members 27 and 28 in either transverse direction is effective not only to move the engaged material outwardly longitudinally of the augers 30 or 32, but is also effective to move the concrete inwardly to a position wherein the two augers 30 and 32 tend to confine the concrete between them, and both augers are effective to move the concrete longitudinally outwardly ahead of the remainder of the surfacing unit 21.

Referring to FIGS. 2 and 3, the carriage 26 of the surfacing unit 21 has two pairs of outwardly projecting, horizontally spaced rollers 37, 37*a* mounted on respective ends thereof in such position that in the assembled machine 20, the rollers 37, 37*a* are disposed in position to be supported by, and ride along the inner edges of elongated tracks 38, 38*a* disposed on opposite sides of the frame 22, to thereby support the surfacing unit 21 for movement longitudinally of the frame 22. The tracks 38 and 38*a* may be supported from the sides of the frame 22 by vertically adjustable hangers (not shown) so that the level of the tracks 38, 38*a* at various points along the frame 22 may be adjusted.

A pair of hold down rollers 45, 45*a* are mounted on each of the ends of the carriage 26 below the respective pair of upper rollers 37, 37*a*, FIG. 2. The hold down rollers 45, 45*a* are disposed in such position that when the carriage 26 is supported on the tracks 38 and 38*a*, the rollers 45, 45*a* are disposed in abutting engagement with the lower faces of the adjacent tracks 38 and 38*a* in position to hold the upper rollers 37, 37*a* downwardly against the tracks 38 and 38*a*.

The operation of the concrete finishing machine 20 in advancing the machine 20 along a roadway being surfaced, and in reciprocating the surfacing unit 21 longitudinally of the roadway as the machine 20 advances is similar to that of the machine shown in the aforementioned Glesmann U.S. Pat. No. 3,738,763. That is, it is intermittently moved longitudinally of the roadway by suitable drive mechanism, not shown, on the bogies 16, 16*a* and between each such movement of the machine 20 longitudinally of the roadway, the surfacing unit 21 is moved transversely across the roadway by suitable drive mechanism typically in the form of hydraulic motors. Control of the operation of the machine 20 may be effected both manually and automatically in the same manner as that disclosed in the aforementioned Glesmann U.S. Pat. No. 3,738,763 with respect to the machine shown therein.

Referring to FIGS. 1–3, the carriage 26 includes a rectangular shaped platform 40 with four vertically extending legs 41–44. The forward pair of legs 41,42 are interconnected at their upper ends by horizontally extending cross beam 46 and the rearward legs are interconnected by a cross beam (not shown), defining a suspension tower, the upper portion which is suspended from the carriage track carried by the frame 22. The platform 40 carries a hydraulic fluid reservoir 48, a hydraulic pump apparatus 49 and associated control mechanisms which supply hydraulic fluid to the carriage drive motor 52, the cylinder drive motor, such as motor 53, the carriage reverse mechanism (not shown), and the machine drive motors (not shown) which drive the concrete finishing machine 20 along the roadway.

The carriage 26 has a forward guard plate 55 which extends vertically downward from the front edge of the carriage 26, and a rear guard plate 56 which extends generally vertically down from the carriage at its rearward end. As shown best in FIG. 2, the forward guard plate 55 has a pair of apertures 58 and 58*a* in which are mounted suitable bearings (not shown) for the shafts 27*a* and 28*a* of the cylinders 27 and 28, respectively. The rear guard plate 56 mounts the drive motors, such as drive motor 53 for cylinder 28, which are connected to the hydraulic pump apparatus 49 via hydraulic lines 49*a*. The motor 53 has an output shaft 53*a* which extends through an aperture 59 in the rear plate 56 and which is coupled to the shaft of the finishing roller or cylinder 28. The drive motors for the cylinders 27 and 28 drive the cylinders in opposite directions.

Referring to FIGS. 2 and 3, the auger guard frame 34 is a generally rectangular frame comprised of three cross members 61, 62 and 63 which are interconnected by two side members 64 and 65. The members 61–65, which are tubular in shape and have a square cross section, are welded together to form the generally rectangular auger guard frame 34.

A pair of hinge plate pairs 68 and 68*a* which extend rearward of and normal to member 63 enable pivotal connection of the auger support frame 34 to forward extensions 67, 67*a* of the forward guard plate 55 of the carriage 26. Hinge pins 69 and 69*a* connect plates 68, 68*a* to forward extensions 67, 67*a* allowing for pivoting of the auger guard frame 34 about an axis extending transverse to the direction of rotation of the cylinders 27 and 28 at the front end of the carriage 26, to raise or lower the front end of the auger unit 18 relative to the finishing rollers.

Referring to FIGS. 2 and 5, for the purpose of controling the amount of inclination of the auger guard frame relative to the longitudinal axis of the cylinders 27 and 28, the adjusting mechanism 36 is connected between cross beam 46 and the center member 62 of the auger guard frame 34. The adjusting mechanism includes a turnbuckle assembly 70 having one end 70*a* pivotally secured to a bracket 71 mounted on bar 46, and its other end 70*b* which is pivotally secured to mounting bracket 72 attached to cross member 62.

The turnbuckle assembly 70 includes a pair of threaded rods 73 and 74, one of which has a left-hand thread and the other a right-hand thread, sleeve-type covers 75 and 76 partially enclosing the rods 73 and 74, respectively, and an adjustment member 77. Adjustment member 77 is in the form of a sleeve having complementary threaded inner end surfaces each of which receives one end of rods 73 and 74, threadably received within covers 75 and 76, and the ends of which are received by respective clevis portions 78 and 79, the yokes of which are secured to respective brackets 70*b* and 70*a* by pins 81 and 82, respectively.

Adjustment sleeve 77 has a pair of rod-shaped handles 83 and 84 which extend normal to the longitudinal axis of the sleeve 77 to facilitate turning of the sleeve 77 during adjustment of the turnbuckle assembly 70 to raise or lower the front end of the auger support frame. As the sleeve 77 is turned clockwise, in the direction of arrow 99 (FIG. 5), the turnbuckle assembly 70 is shortened, pivoting the auger support frame 34 upwards about the hinge pins 69, 69*a* to raise the forward ends of the augers. Counterclockwise turning of the sleeve 77 results in lengthening of the turnbuckle assembly 70, pivoting the auger support frame 34 downwardly about pivot pins 69, 69*a*, lowering the front end of the auger support frame to lower the forward ends of the augers. Covers 75 and 76 have raised portions 75*a*, 76*a* which define stop surfaces for locking the adjustment sleeve in place after it has been adjusted. Cover 75 has a pair of handles 85 and 86 which extend normal to the longitudinal axis of the cover 74 to facilitate turning of the cover, in backing off the cover from its locking position prior to adjustment of the turnbuckle assembly, and in turning the cover to its locking position after such adjustment has been made.

Cross member 61 has a pair of generally rectangular plate-like hangers 91 and 92 suspended from the bottom surface thereof and which mount bushings 93 and 94 at their bottom edges. The bushings 93 and 94 receive the free ends of the shafts 30*a*, 32*a* of the augers 30 and 32. As shown in FIG. 4, each bushing such as bushing 94 thereshown, is keyed at 94*a* to its associated shaft 32*a*. By way of example, the bushing may be a relubable bronze bushing unit with a twin urethane seal 95 covering the junction of the shaft and the bushing.

Referring to FIGS. 2 and 3, the drive ends of each of the shafts 30*a* and 32*a* of the augers 30 and 32 are coupled to the output ends of the shafts 27*a* and 28*a* by flexible couplings 96, 96*a*. The flexible couplings may comprise U-joints or spring-type devices, enclosed with a suitable lubricated cover 96', 96*a'*, or members of a flexible material, such as a section of rubber hose or the like. The flexible coupling enables the shafts 30*a* and 32*a* of the augers 30 and 32 to be hitched together in such a way as to provide a flexible coupling therebetween. The flexible coupling permits pivoting of the auger shafts about the points at which they are coupled to the finishing cylinder shafts, vertically upward or downward relative to the shafts 27*a* and 28*a* of the corresponding cylinder while enabling the augers 30 and 32 to be driven by the cylinder shafts 27*a* and 28*a*.

Referring to FIGS. 1 and 3, in use of the concrete finishing machine 20, with the concrete finishing machine 20 positioned over a roadway or the like, straddling the roadway to be surfaced, the grade is set by adjusting the height of the machine 20 at each side thereof relative to the roadway by operating the hand jacks 17, 17*a*. Assuming initially that the shafts of the augers 30 and 32 are in line with the shafts of the cylinders 27 and 28, the forward hand jacks, such as hand jack 17, are adjusted to locate the forward edge of the cylinders at the height to engage and set the finished grade surface of the concrete. The rearward hand jacks, such as hand jack 17*a*, are then adjusted to raise the rear or trailing edge of the cylinders so that they will just touch or almost touch the finished grade surface of the concrete. The two cylinders 27, 28 are set parallel to the machine main frame 22 with the forward and rearward ends of the finishing cylinders on grade.

The front ends of the two cylinders 27 and 28 are set at a height sufficient to leave a little concrete for finishing, typically 1 inch, over the height of the bottom edge of the cylinder. This provides a grout in front of the cylinders to permit optimum finishing.

Referring to FIGS. 2 and 3, after the height of the finishing cylinders has been set to establish the correct grade for the finished concrete surface, then the position of the auger unit 18 is adjusted to locate the augers at the desired height over the roadway. The forward edge of the auger support frame is raised by adjusting the turnbuckle 70, thereby raising the leading edges of the augers 30 and 32, as the auger support frame pivots about the hinges 69 and 69*a* pins, and the auger shafts pivot about the flexible couplings 95, 95*a*. In this way, the angle of inclination of the augers is adjusted to compensate for the cylinder adjustment so that the augers extend generally horizontal to the surface of the roadway being paved. The concrete finishing machine 20 is operated in a manner known in the art with the carriage 26 being driven back and forth along the carriage track, reversing each time it reaches the end position as is known in the art. The concrete finishing machine 20 is moved forward by its drive (not shown).

I claim:

1. In a concrete finishing machine of the type embodying an elongated main frame having first and second ends, height adjusting means for adjusting the vertical height of the main frame, means for moving the main frame longitudinally along a roadway or the like being surfaced, a surfacing unit for finishing a concrete surface, and means for moving the surfacing unit longitudinally back and forth along the main frame between its first and second ends, said surfacing unit comprising:

a carriage;

finishing cylinder means;

means rotatably mounting said cylinder means in said main frame;

drive means coupled to said cylinder means for rotating said cylinder means;

first and second augers;

auger support means including an auger support frame extending generally axially of said cylinder means, said auger support frame having a forward end and a rearward end, mounting means pivotally mounting said auger support frame at its rearward end to said carriage, suspension means on said auger support frame near the forward end thereof and extending downwardly therefrom supporting forward ends of said first and second augers, and flexible coupling means coupling rearward ends of said first and second augers to said cylinder means, whereby said augers are rotated by said drive means as said cylinder means is rotated, and adjustable support means connected between said carriage and said auger support frame, said adjustable support means adjustable to vary the angle of inclination of said auger support frame and the augers supported thereby relative to the longitudinal axis of said cylinder means.

2. A concrete finishing machine according to claim 1, wherein the height adjusting means includes means adjusted to position the main frame at a vertical height to locate the ends of said finishing cylinder means at a vertical height to engage unfinished concrete and set the final grade for the finished concrete surface, and said adjustable support means includes means adjusted to position the auger support frame relative to the roadway being surfaced for maintaining at the leading edge of said finishing cylinder sufficient concrete to permit optimum finishing.

3. A concrete finishing machine according to claim 1, wherein said flexible coupling means comprises a U-joint assembly enabling pivotal movement of said augers relative to the axis of said cylinder means.

4. A concrete finishing machine according to claim 1, wherein said adjustable support means comprises a turnbuckle means having a first end connected to said auger support frame and a second end connected to said carriage.

5. A concrete finishing machine according to claim 1, wherein said finishing cylinder means includes first and second finishing cylinders extending in substantially parallel relation to one another, said flexible coupling means coupling shafts of said first and second augers to shafts of said first and second cylinders, respectively.

6. A concrete finishing machine according to claim 5, wherein said flexible coupling means comprises a first spring member connected between said first auger and said first cylinder and a second spring member connected between said second auger and said second cylinder.

7. A concrete finishing machine according to claim 5, wherein said flexible coupling means comprises a first and second section of hose each receiving one end of the associated cylinder shaft and one end of the associated auger shaft.

8. In a concrete finishing machine of the type embodying an elongated main frame having first and second ends, height adjusting means for adjusting the vertical height of the main frame, means for moving the main frame longitudinally along a roadway or the like being surfaced, a surfacing unit for finishing a concrete surface, and means for moving the surfacing unit longitudinally back and forth along the main frame between its first and second ends, said surfacing unit comprising:

a carriage;

first and second finishing cylinders each having a drive shaft with first and second ends;

first and second augers;

means rotatably mounting said cylinders by their shafts in substantially parallel relationship to one another and to the longitudinal axis of said main frame;

drive means coupled to first ends of said cylinder shafts for rotating said cylinders;

auger support means including an auger support frame extending generally axially of said cylinders, said auger support frame having a forward end and a rearward end, mounting means pivotally mounting said auger support frame at its rearward end to said carriage in pivotal relation therewith, suspension means on said auger support frame near the forward end thereof and extending downwardly therefrom supporting forward ends of said first and second augers, and flexible coupling means coupling rearward ends of said first and second augers to second ends of said first and second cylinder shafts, respectively, whereby said augers are rotated by said drive means as said cylinders are rotated, and adjustable support means connected between said carriage and said auger support frame, said adjustable support means adjustable to vary the angle of inclination of said auger support frame and the augers supported thereby relative to the longitudinal axis of said first and second cylinders.

9. A concrete finishing machine according to claim 8, wherein the height adjusting means includes means adjusted to position the ends of the main frame at a vertical height to position the ends of said finishing cylinders at a vertical height to engage unfinished concrete and set the final grade for the finished concrete surface, and said adjustable support means includes means adjusted to position the auger support frame relative to the roadway being surfaced for maintaining at the leading edge of said finishing cylinders sufficient concrete to permit optimum finishing.

10. A concrete finishing machine according to claim 8, wherein said adjustable support means comprises a turnbuckle means having a first end connected to said auger support frame and a second end connected to said carriage.

11. A concrete finishing machine according to claim 8, wherein said flexible coupling means comprises a pair of U-joints enabling pivotal movement of said augers relative to the axis of said finishing cylinders.

12. A concrete finishing machine according to claim 11, wherein said flexible coupling means comprises a first spring member connected between said first auger and said second end of said first cylinder shaft and a second spring member connected between said second auger and said second end of said second cylinder shaft.

* * * * *